United States Patent [19]

Larws

[11] Patent Number: 4,813,904

[45] Date of Patent: Mar. 21, 1989

[54] BASE ELEMENT FOR THE PRODUCTION OF PANELS FOR A TOY CONSTRUCTION SYSTEM

[76] Inventor: Peter Larws, Schlappmuhler Pfad 13, D-6390 Usingen, Fed. Rep. of Germany

[21] Appl. No.: 210

[22] Filed: Jan. 2, 1987

[30] Foreign Application Priority Data

Jan. 23, 1986 [DE] Fed. Rep. of Germany ..... 3601946

[51] Int. Cl.[4] ..... A63H 33/04

[52] U.S. Cl. ..... 446/118; 446/108

[58] Field of Search ..... 446/118, 128, 124, 85, 446/111, 122, 108; D21/108; 52/606, 607

[56] References Cited

U.S. PATENT DOCUMENTS 3,274,727 9/1966 Zander ..... 446/118

4,164,091 8/1979 Lin ..... 446/118

FOREIGN PATENT DOCUMENTS 1128342 4/1962 Fed. Rep. of Germany ..... 446/128

1140500 11/1962 Fed. Rep. of Germany ..... 446/128

*Primary Examiner*—Mickey Yu

*Attorney, Agent, or Firm*—Barnes & Thornburg

[57] ABSTRACT

For the production of panels of a toy construction set, a base element of rectangular shape is disclosed, which as at least two square openings a×a, and which constitutes a flat hollow body, which is open on one large rectangular surface. The distance of the openings from the outer surfaces of the base element is a/2. Preferably, the base element has at least eight openings, which are arranged in at least two rows which lie on top of each other in rectangular array, each row comprising at least four openings which are next to each other.

10 Claims, 3 Drawing Sheets

BASE ELEMENT FOR THE PRODUCTION OF PANELS FOR A TOY CONSTRUCTION SYSTEM

This invention at hand concerns a base element for the production of panels with large surfaces for unitized toy construction sets.

Various unitized construction sets for children, including those will pieces or sections having large surfaces are known. However, either the forming or molding costs for exact production of the necessary and different large-surfaced pieces are uneconomically high, or these pieces or sections hold together very poorly when joined together as a result of inexact shaping through cheap processes, like blow-molding.

DE-GM No. 7 007 072 describes toy building components having differing lengths, which are square-edged elements with square openings, and which have a distance from each other corresponding to one unit side-length of the square openings. These square-edged elements can be joined with each other using connecting elements.

DE-OS No. 30 15 697 describes a building set for the building together of toys, which consist of square-shaped building sections, which are assembled from two half-shells or plates.

The objective of the invention at hand is a base element for the production of large-surfaced panels for a unitized toy construction set, especially for an insertable or plug-in building block set. This base element should permit the creation of panels with varying size at minimal production costs, whose square openings appear in sensible grouping.

This objective is reached with a base element of rectangular shape, which is a hollow body open at one of the rectangular surfaces so that the base element can be joined with other similar base elements by welding, gluing, insertion, bolting, or other suitable methods to form fully enclosed panels. These hollow bodies are laid on top of each other with their open sides confronting each other to create panels for a unitized construction system. The base elements each have at least eight square openings of dimensions a×a, the openings being situated in a rectangular array a distance a from each other in at least two rows of at least four openings.

Preferably, the distance of the openings to the outer borders of the base elements is half as much as the distance between the openings i.e.=a/2. The thickness of the base elements is also half the distance between the openings so that the assembled base elements have a panel thickness which is the same as the distance between the openings, i.e. a. Alternatively, the thickness of the base elements can be the same as the distance between the openings so that the assembled base panel has a thickness of 2a.

In the production of panels according to the invention, only one molding tool will be needed for the base element, even for varying panel sizes, as this base element, by means of suitable arrangement of the openings, can be assembled or joined with one or more other base elements to create fully enclosed panels of various sizes. The joining of the base elements can be achieved by welding, gluing, insertion or plugging in, screwing, or bolting, or other suitable methods.

Additional features and advantages of the invention will become apparent to those skilled in the art upon consideration of the following detailed description of preferred embodiments exemplifying the best mode of carrying out the invention as presently perceived. The detailed description particularly refers to the accompanying figures in which.

Figure 1:
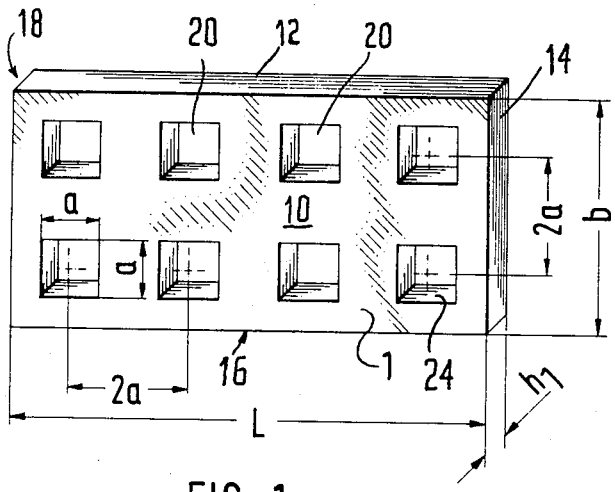
FIG. 1 shows a base element with eight square openings in perspective viewed from the closed side.

A base element 1 according to the present invention is shown in FIG. 1 to include a rectangular front surface 10, bounded by four rearwardly extending edges 12, 14, 16, and 18. The front surface 10 includes eight square openings 20 which are each dimensional a×a. The base element 1 has length L, breadth b and thickness $h_1$. The distance of the openings 20 from each other equals a and the distance of the openings from the outer edges 12, 14, 16, 18 is a/2.

Figure 2:
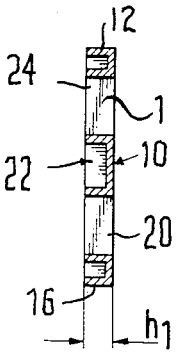
FIG. 2 shows a cross-section of the base element at the position of the openings.

As can be seen in FIG. 2, the base element 1 has a hollow rear surface 22 enclosed by edges 12, 14, 16, and 18 and interrupted by the openings 20. The openings 20 are shown to each be defined by four walls 24 extending rearwardly a distance equal to edges 12, 14, 16, and 18.

Figure 3:
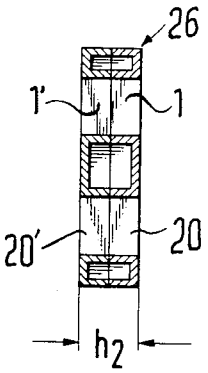
FIG. 3 shows a cross-section through two base elements which have been welded or glued together in a mirror-inverted way to form a base plate.
Figure 4:
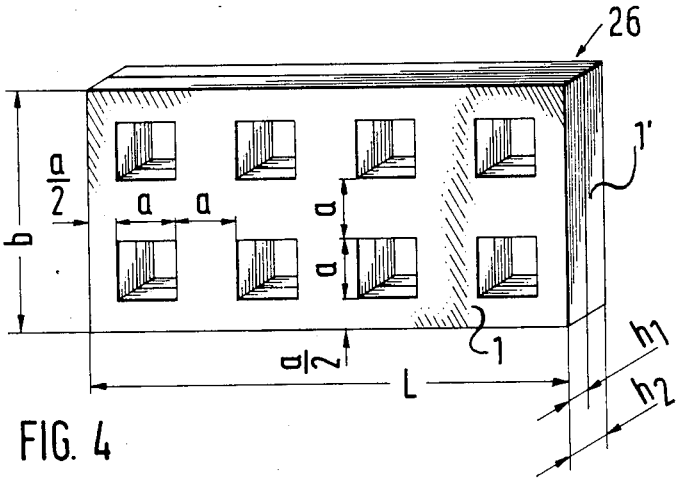
FIG. 4 is a perspective view of the base plate shown in FIG. 3.

The element 1 and a congruently dimensioned element 1' can be joined together in confronting mirror-inverted fashion as shown in FIG. 3 and FIG. 4 to form a base plate or tile 26 in accordance with this invention. The base elements are joined and/or bounded such that the openings 20 of element 1 are aligned with the openings 20' of element 1'. The overall thickness of the base plate or tile 26, $h_2$, is twice that of the thickness of the element 1, i.e. $h_2=2h_1$. As one can observe from the Figures, the base elements shaped according to the invention can be assembled with each other in various manners to make large-surfaced panels of the most varied shapes by the joining of their open surfaces to each other;

FIG. 4 shows two base elements 1, 1', which have been joined together by their open sides in a mirror-inverted fashion. These base elements have a two by four array of eight openings. Since each square opening has a measurement a×a, the length L of the base element can be calculated as follows:

| |
|---|
| 4 × openings of the side-length a = 4a<br>+ 3 × the distance between the<br>openings of the amount a = 3a<br>+ 2 × the distance to the outer<br>borders of the amount a/2 = 1a,<br>Length L of the base element with<br>8 openings consequently is = 8a. |

The breadth b of the base element can be calculated as follows:

| |
|---|
| 2 × opening of measurement a = 2a |

-continued

| |
|---|
| + 1 × distance between openings of the amount a = 1a |
| + 2 × distance to the outer boundaries of the amount a/2 = 1a. |
| Breadth b of the base element with 8 openings is consequently = 4a. |

With a thickness $h_1$ of the base element of a/2, the dimensions of a base element with 4×2 array of 8 openings are consequently $L \times b \times h_1 = 8a \times 4a \times a/2$. If one joins two jons base elements into a panel 26 with 8 openings together as shown in FIG. 4, the panel 26 has a measurement 8a×4a×a.

Figure 5:
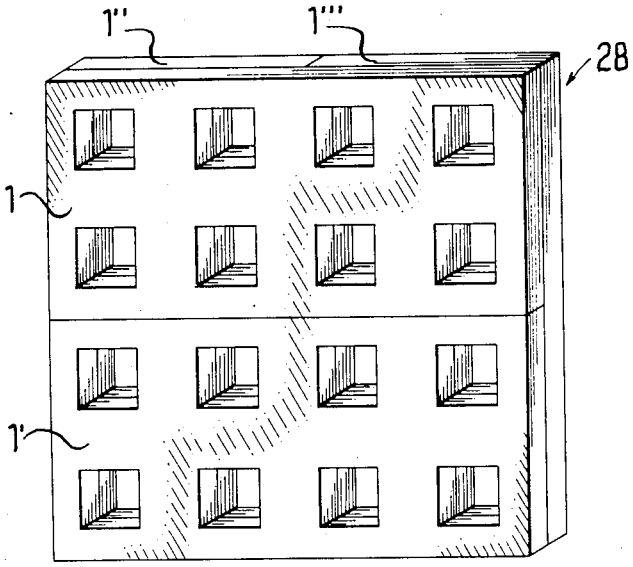
FIG. 5 is a perspective view of a base plate constructed of 4 of the base elements shown in FIGS. 1 and 2.

FIG. 5 shows a panel 28 with a 4×4 array of 16 openings, constructed from four congruent base elements 1, 1', 1'', 1'''. This panel 28 then has the dimensions 8a×8a×a.

Figure 6:
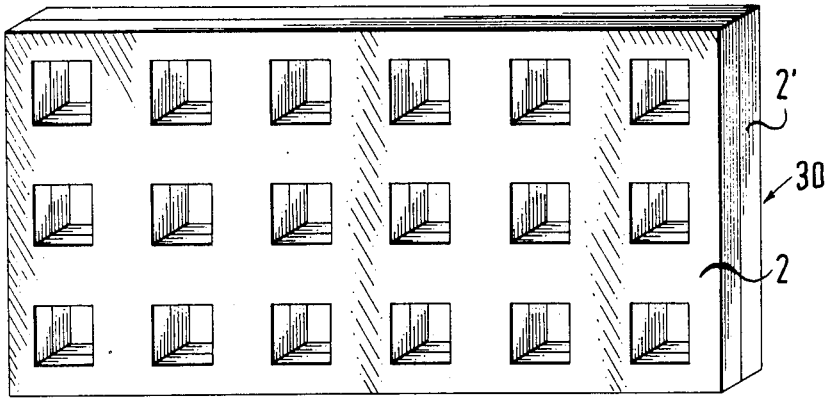
FIG. 6 is a perspective view of a base plate constructed of two base elements, each element having eighteen openings arranged in a six by three array.

FIG. 6 shows two base element 2, 2', which have been joined in a mirror-inverted fashion with their open sides confronting each other. These base elements 2, 2' have a 6×3 array of 18 openings. Since the square openings have a dimension a×a, the dimension for the joined panel 30 made from base elements 2, 2' is 12a×6a×a.

Figure 7:
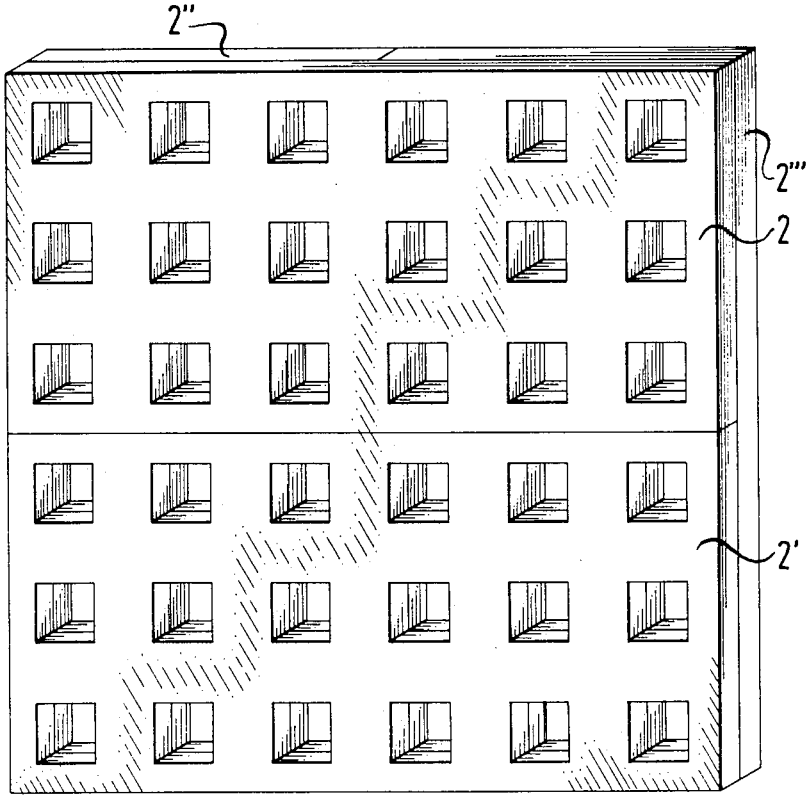
FIG. 7 is a perspective view of a base plate constructed of four base elements as shown in FIG. 6.

FIG. 7 shows a panel 32 with a 6×6 array of 36 openings, constructed from 4 similar base elements 2, 2', 2'', 2'''. This panel therefore has a dimensions 12a×12a×a.

Fundamental to the invention is that the lengths of the base elements are always a whole multiple of, however, at least two times the breadth of the base element. For example, L=nb where n=2, or 3, or 4, or . . . By the rotation of the base elements with respect to each other at right angles or by staggered arrangement such that the openings are not coinciding by flush outer-contour of the joined panels, even larger base plates or tiles can be constructed. This coinciding arrangement with respect to the openings according to the invention is arrived at in that the distance a between the openings is the same as the side-length a×a of the openings, and in that the distance of the opening to the outer borders of the base element is the same as a/2. Thus it is always possible, whatever large panels are desired, to join a number of base elements together to form a length/-breadth-relationship of the base element of 2:1.

The panels shown in the Figures can be meaningfully combined for instance with plug-in building blocks according to DE-PS No. 21 61 913.

Considering certain relationships between the dimensions measurement of the openings and the distance between the openings, there are optimum conditions for combining the base elements with the objective of constructing panels with varying sizes. Simultaneously it can be made certain that the panels which have been made in this way, can be built up together. According to the invention, this can be arrived at by the distance between the openings a being twice as much as the distance a/2 to the outer boundaries of the base element. The additional requirement that the square cross-section of the opening has a side-length a, is thus not a necessary pre-requisite. Basically the same advantages and possibilities are present, when the openings are circular or have another desired shape (for instance are star-shaped with 4 or 8 rays).

Although the invention has been described in detail with reference to certain preferred embodiments, variations and modifications exist within the scope and spirit of the invention as described and as defined in the following claims.

What is claimed is:

1. A base element of rectangular shape, comprising a hollow body having a rectangular surface, vertical side walls extending generally perpendicularly from said rectangular surface and defining an open rectangular area between said side walls; the base element being adapted to be joined with one or more other similar base elements by their side walls and at their mutual open areas by welding, gluing, insertion, bolting, or other suitable methods to form a fully enclosed panel for a construction set, the base element having at least eight openings in said rectangular surface arranged a distance (a) from each other and in a rectangular array of at least two rows of at least four openings, each openings having a square cross-section with a side length equal to the distance (a), and wherein the distance from the openings, located adjacent to an outer border of the base element, to the outer border of the base element is half the distance (a) between the openings.

2. The base element according to claim 1, wherein the hollow body has a thickness which is equal to the distance from the openings, located adjacent to an outer border of the base element, to the outer border so that two assembled base elements form a panel having a thickness which is the same as the distance of the openings from each other.

3. The base element according to claim 1, wherein the hollow body has a thickness which is equal to the distance (a) between the openings so that two assembled base elements form a panel having a thickness of (2a).

4. The base element according to claim 1, wherein the hollow body has more than eight openings, which, if necessary, are arranged in more than two rows of openings.

5. A base element according to claim 1, wherein the rectangular surface has a substantially flat upper surface and said hollow body has four vertical side walls; said side walls defining the thickness of the body; said at least eight openings being defined by vertical opening walls at right angles to the flat upper surface about the openings and extending for said full thickness; and wherein the hollow of the hollow body is defined by the space between the vertical side walls and the vertical opening walls.

6. The base element according to claim 1, wherein the hollow body has a length and a breadth, the length being a whole multiple of and at least twice the breadth.

7. The base element according to claim 1, wherein two identical hollow bodies are joined by their side walls at their mutual open areas to form a panel.

8. The base element according to claim 1, wherein two identical bodies are joined along an outer surface of the side wall.

9. The base element according to claim 7, wherein an additional said panel formed by two identical hollow bodies is joined along an outer surface of the side wall of the hollow bodies of the first panel.

10. The base element according to claim 8, wherein two additional hollow bodies are also adjoined along an outer surface of the side wall and wherein these additional two hollow bodies are joined to the first two hollow bodies at their mutual open areas to form a panel with the two joined side walls of the additional hollow bodies being at right angles to the two joined side walls of the first hollow bodies.

* * * * *